US008678141B2

(12) United States Patent
Gieras et al.

(10) Patent No.: US 8,678,141 B2
(45) Date of Patent: Mar. 25, 2014

(54) ELECTROMAGNETIC COUPLING WITH A SLIDER LAYER

(75) Inventors: Jacek F. Gieras, Glastonbury, CT (US); Peng Wang, Cheshire, CT (US); Lisa A. Prill, Glastonbury, CT (US); Pei-Yuan Peng, Ellington, CT (US); Bryan Slewert, Westbrook, CT (US); Robert H. Dold, Monson, MA (US)

(73) Assignee: Otis Elevator Company, Farmington, CT (US)

( * ) Notice: Subject to any disclaimer, the term of this patent is extended or adjusted under 35 U.S.C. 154(b) by 1232 days.

(21) Appl. No.: 12/522,579

(22) PCT Filed: Mar. 23, 2007

(86) PCT No.: PCT/US2007/064760

§ 371 (c)(1),
(2), (4) Date: Jul. 9, 2009

(87) PCT Pub. No.: WO2008/118163

PCT Pub. Date: Oct. 2, 2008

(65) Prior Publication Data

US 2010/0038187 A1 Feb. 18, 2010

(51) Int. Cl.
*B66B 13/12* (2006.01)
*E05F 17/00* (2006.01)
*H01F 7/20* (2006.01)

(52) U.S. Cl.
USPC ..... 187/330; 187/319; 49/116; 49/119; 49/120; 335/281; 335/291; 335/295

(58) Field of Classification Search
USPC ..... 187/319, 330; 49/116, 120, 370, 118, 49/119; 335/296, 273, 277, 281, 295, 301; 307/104
IPC ..... E06B 3/46; E05F 3/22,17/00; B66B 13/12
See application file for complete search history.

(56) References Cited

U.S. PATENT DOCUMENTS 2,427,826 A * 9/1947 Warsher ..... 335/281
4,956,625 A * 9/1990 Cardone et al. ..... 335/290

(Continued)

FOREIGN PATENT DOCUMENTS

EP 0829447 A1 3/1998
JP 4512453 5/1970

(Continued)

OTHER PUBLICATIONS

International Search Report and Written Opinion of the International Searching Authority for International application No. PCT/US2007/064760 mailed Dec. 12, 2007.

(Continued)

*Primary Examiner* — William A Rivera
*Assistant Examiner* — Stefan Kruer
(74) *Attorney, Agent, or Firm* — Carlson, Gaskey & Olds

(57) ABSTRACT

An exemplary electromagnetic coupling device includes an electromagnet and a vane member that is selectively magnetically coupled with the electromagnet. A non-magnetic slider layer is supported on one of the electromagnet or the vane member such that the slider layer is between the electromagnet and the vane member. The slider layer maintains a spacing between the electromagnet and the vane member. In a disclosed example, the electromagnetic coupling device is used for coupling an elevator car door to a hoistway door for moving the doors in unison between open and closed positions.

11 Claims, 5 Drawing Sheets

(56) References Cited

U.S. PATENT DOCUMENTS

| | | | | | |
|---|---|---|---|---|---|
| 5,174,417 | A | * | 12/1992 | Pilsbury | 187/330 |
| 5,487,449 | A | | 1/1996 | Barrett et al. | |
| 5,917,774 | A | * | 6/1999 | Walkow et al. | 367/25 |
| 6,198,369 | B1 | * | 3/2001 | Ward et al. | 335/220 |
| 6,292,077 | B1 | * | 9/2001 | Kaizuka et al. | 335/281 |
| 6,559,560 | B1 | * | 5/2003 | Jin et al. | 307/104 |
| 6,874,751 | B2 | * | 4/2005 | Ojima et al. | 251/129.15 |
| 2003/0148120 | A1 | * | 8/2003 | Minnick | 428/461 |
| 2007/0152790 | A1 | * | 7/2007 | Telep | 335/255 |

FOREIGN PATENT DOCUMENTS

| | | | | | |
|---|---|---|---|---|---|
| JP | 162280 | | | 4/1989 | |
| JP | 03261022 | A | * | 11/1991 | H01H 50/16 |
| JP | 7309564 | A | | 11/1995 | |
| JP | 10036046 | | | 2/1998 | |
| WO | 2006009536 | A2 | | 1/2006 | |

OTHER PUBLICATIONS

International Preliminary Report on Patentability for International application No. PCT/US2007/064760 mailed Jun. 12, 2009.

* cited by examiner

ELECTROMAGNETIC COUPLING WITH A SLIDER LAYER

BACKGROUND

Elevators typically include a car that moves vertically through a hoistway between different levels of a building. At each level or landing, a set of hoistway doors are arranged to close off the hoistway when the elevator car is not at that landing. The hoistway doors open with doors on the car to allow access to or from the elevator car when it is at the landing. It is necessary to have the hoistway doors coupled appropriately with the car doors to open or close them.

Conventional arrangements include a door interlock that typically integrates several functions into a single device. The interlocks lock the hoistway doors, sense that the hoistway doors are locked and couple the hoistway doors to the car doors for opening purposes. While such integration of multiple functions provides lower material costs, there are significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these functions are typically integrated into a single device, their design implications are usually competing with each other.

Conventional door couplers include a vane on the car door and a pair of rollers on a hoistway door. The vane must be received between the rollers so that the hoistway door moves with the car door in two opposing directions (i.e., opening and closing). Common problems associated with such conventional arrangements is that the alignment between the car door vane and the hoistway door rollers must be precisely controlled. This introduces labor and expense during the installation process. Further, any future misalignment results in maintenance requests or call backs.

It is believed that elevator door system components account for approximately 50% of elevator maintenance requests and 30% of callbacks. Almost half of the callbacks due to a door system malfunction are related to one of the interlock functions.

There is a need in the industry for an improved arrangement that provides a reliable coupling between the car doors and hoistway doors, yet avoids the complexities of conventional arrangements and provides a more reliable arrangement that has reduced need for maintenance. One proposal has been to replace mechanical components with electromagnetic components. Examples are shown in U.S. Pat. Nos. 6,070,700; 5,174,417 and 1,344,430.

Implementing electromagnetic elevator door coupler devices is not without challenges. For example, residual current within an electromagnet's coil after the electromagnet has been turned off can tend to keep an electromagnet and a coupled component such as a vane coupled together although separation is desired. There is also a competing concern between maintaining a sufficiently adequate coupling force while still allowing some relative vertical movement between magnetically coupled components to accommodate changes in elevator car position during loading or unloading at a landing, for example. It is also necessary to attempt to prevent an accumulation of ferrous debris on an active surface of an electromagnet.

SUMMARY

An exemplary electromagnetic coupling device includes an electromagnet and a vane member that is selectively magnetically coupled with the electromagnet. A non-magnetic sliding layer is supported on one of the electromagnet or the vane member. The sliding layer is between the electromagnet and the vane member for maintaining a spacing between the electromagnet and the vane member.

The various features and advantages of the disclosed examples will become apparent to those skilled in the art from the following detailed description. The drawings that accompany the detailed description can be briefly described as follows.

DETAILED DESCRIPTION

Figure 1:
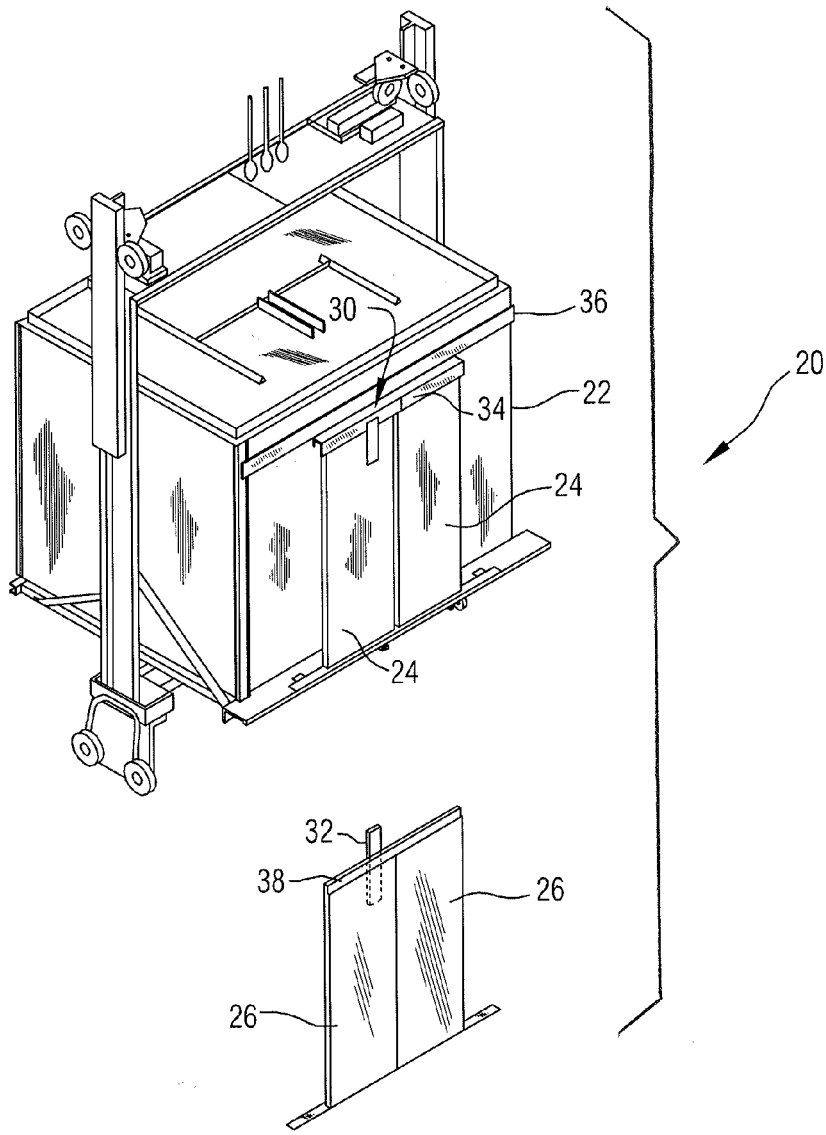
FIG. 1 schematically illustrates selected portions of an elevator system.

FIG. 1 schematically shows an elevator door assembly 20 that includes a unique door coupler. An elevator car 22 has car doors 24 that are supported for movement with the car through a hoistway, for example. The car doors 24 become aligned with hoistway doors 26 at a landing, for example, when the car 22 reaches an appropriate vertical position.

The illustrated example includes a door coupler to facilitate moving the car doors 24 and the hoistway doors 26 in unison when the car 22 is appropriately positioned at a landing. In this example, the door coupler includes an electromagnet 30 associated with at least one of the car doors 24. At least one of the hoistway doors 26 has an associated vane 32 that cooperates with the electromagnet 30 to keep the doors 26 moving in unison with the doors 24 as desired.

In the illustrated example, the electromagnet 30 is supported on a door hanger 34 that cooperates with a track 36 in a known manner for supporting the weight of an associated door and facilitating movement of the door. The vane 32 in this example is supported on a hoistway door hanger 38.

Figure 2:
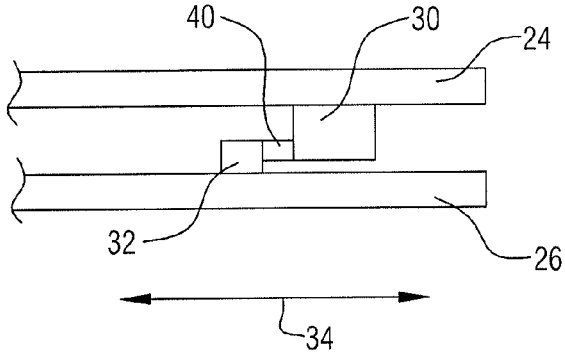
FIG. 2 schematically illustrates operation of an example coupler device.

As can be appreciated from FIG. 2, when the electromagnet 30 is selectively energized while the elevator car 22 is at an appropriate landing, the electromagnet 30 and the vane member 32 are magnetically coupled. The attractive force associated with the magnetic coupling is sufficient to keep the electromagnet 30 and the vane member 32 moving together to cause a desired movement of the car door 24 and the hoistway door 26 in unison as schematically shown by the arrow 34 (e.g., between open and closed positions).

As shown in FIG. 2, a sliding layer 40 is provided to maintain a spacing between the electromagnet 30 and the vane member 32 even when they are electromagnetically coupled together. The sliding layer 40 in one example is supported on the electromagnet 30. In another example, the sliding layer 40 is supported on the vane member 32. Another example includes a sliding layer on each of the electromagnet 30 and the vane member 32.

Providing at least one sliding layer 40 between the electromagnet 30 and the vane member 32 is useful for maintaining at least some spacing between the electromagnet 30 and the vane member 32 to facilitate separating them when desired. When the electromagnet 30 is energized to magnetically couple the electromagnet 30 with the vane member 32, a desired magnetic attractive force is generated. After the electromagnet 30 is turned off, residual magnetic flux of the electromagnet can tend to keep the electromagnet 30 coupled to the vane 32. Such a residual attractive force may prevent a desired separation between the electromagnet 30 and the vane member 32. This is especially true if there is direct contact between them. Having a non-magnetic sliding layer 40 between them ensures reliable separation when desired.

Maintaining some spacing between the electromagnet 30 and the vane member 32 is useful because the attraction force between them is inversely proportional to the size of the gap between them squared. The attraction force tends to be infinity when there is a zero gap between the electromagnet 30 and the vane member 32. Even a very small gap provided by a relatively thin sliding layer 40 is sufficient to decrease residual magnetism associated with any residual magnetic flux of the electromagnet 30 after power is turned off to the electromagnet. By making the sliding layer 40 sufficiently thick, the attraction force of any residual magnetism can be effectively reduced to zero.

Some example sliding layers are in range from 0.1 mm to 3 mm. One example includes a sliding layer thickness of at least 0.5 mm. Given this description, those skilled in the art who have information regarding their particular electromagnet design will be able to select appropriate materials and thicknesses for the sliding layer to meet the needs of their particular situation.

In one example, the sliding layer 40 comprises a low friction material. One example includes polytetrafluoroethylene (e.g., Teflon®) as at least one of the components of the sliding layer 40. Using a low friction material accommodates relative vertical movements between the electromagnet 30 and the vane member 32 responsive to changes in the position of the car 22 during loading or unloading at a landing, for example. Using a low friction material for the sliding layer 40 reduces wear on the electromagnet and vane 32 under such circumstances. Example materials that are useful as sliding layers that are commercially available include Rynite 530, Delrin 500AF and Delrin 100AF.

The sliding layer in one example provides a relatively low coefficient of friction between the sliding layer and the vane member 32 (in an example where the sliding layer is supported on the electromagnet 30). The coefficient of friction in one example is in a range from 0.15 to 0.3. One example includes selecting materials so that the coefficient of friction is approximately 0.2.

Another advantage of the example sliding layer 40 is that it minimizes an accumulation of ferrous debris on the active surface of the electromagnet 30 (e.g., the surface facing the vane 32). Any ferrous debris attracted by the electromagnet 30 when it is energized that is received against the sliding layer 40 will be spaced from the electromagnet 30 by at least the thickness of the sliding layer 40 so that when the electromagnet 30 is turned off, the ferrous debris will fall away from the electromagnet 30 by its own weight.

Another advantage to the example sliding layer 40 is that it provides a cushioning effect as the electromagnet 30 and the vane member 32 approach each other during an initiation of a magnetic coupling between them. Using a non-magnetic sliding layer 40 and selecting a material that is softer than the ferromagnetic materials of the electromagnet 30 and the vane 32 allows for reducing noise associated with physical contact between the components as they are magnetically coupled together. Reducing noise in this regard is an advantage because passengers or individuals waiting for the arrival of the elevator car will not hear any banging noise that may otherwise occur if there were metal-to-metal contact, for example.

The material selected for the sliding layer in some examples has a thermal expansion coefficient that is close to that of the materials selected for the electromagnet core, the vane member or both. In one example, the sliding layer material has a thermal expansion coefficient that is close to that of mild steel.

Figure 3:
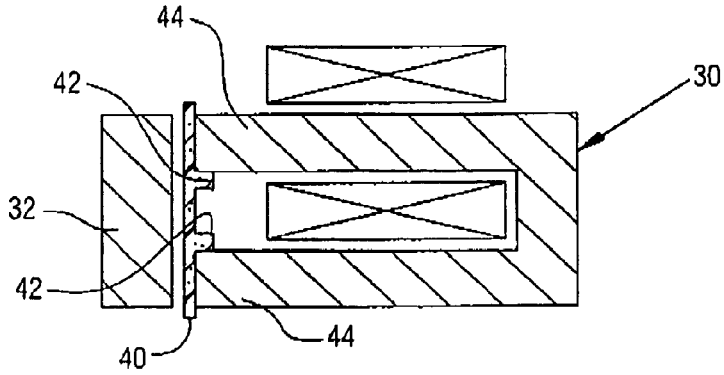
FIG. 3 is a cross-sectional illustration showing selected portions of an example electromagnetic coupling device.

FIG. 3 shows one example arrangement where the electromagnet 30 has a generally U-shaped core. The sliding layer 40 in this example includes a mounting feature 42 that is received against at least one surface on a pole 44 of the electromagnet 30. In this example, the mounting feature 42 comprises a plurality of beads or tabs on the sliding layer 40. The mounting feature 42 in this example is received against oppositely facing surfaces on the poles 44 so that the sliding layer 40 is maintained in a desired position relative to the electromagnet 30 without requiring any adhesive or fasteners that are separate from the sliding layer 40, itself.

Figure 4:
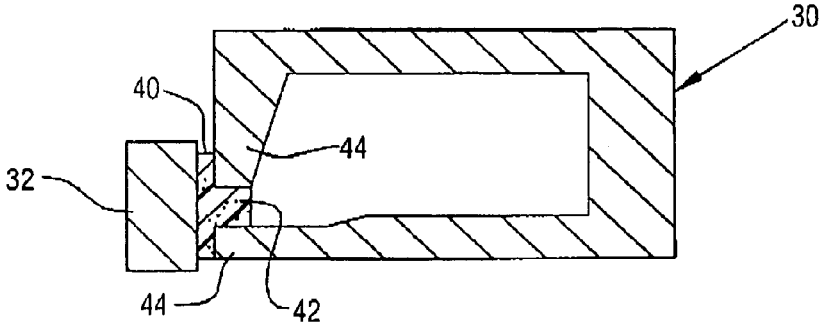
FIG. 4 is a cross-sectional illustration showing selected portions of another example electromagnetic coupling device.

FIG. 4 schematically shows another example arrangement where the electromagnet 30 has a core shape including the poles 44 being relatively close together. In this example, the mounting feature 42 is received between oppositely facing surfaces on the poles 44 to secure the sliding layer 40 in a desired position relative to the electromagnet 30.

Figure 5:
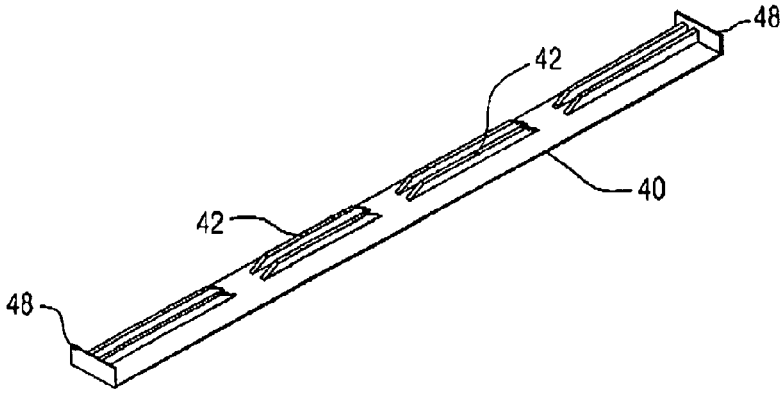
FIG. 5 is a perspective illustration of one example sliding layer.

The mounting feature 42 may take a variety of forms. FIG. 5 shows one example where raised beads are provided along a length of the sliding layer 40. The raised beads have a dimension and a spacing between them that corresponds to an arrangement of pole surfaces on a corresponding electromagnet. The mounting feature beads 42 facilitate establishing an interference fit such that the sliding layer 40 is held in place against an electromagnet by engagement between the beads and the pole surfaces. The example of FIG. 5 also includes end caps 48 that are received against outer edges of an electromagnet in one example. The end caps 48 secure the sliding layer 40 against movement in a direction parallel to the beads. The speacing between the end caps 48 in one example is approximately equal a length of corresponding poles on the electromagnet 30. The beads secure the sliding layer 40 against movement relative to the electromagnet in a direction away from the electromagnet. In other words, the combination of the beads and the end caps 48 secure the sliding layer 40 against an electromagnet to prevent movement in two different directions.

Figure 6:
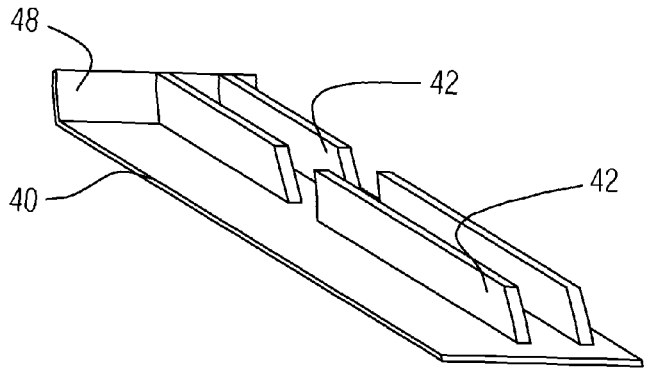
FIG. 6 is a perspective illustration of another example sliding layer.

FIG. 6 schematically shows another example where the mounting feature 42 includes raised tabs on the sliding layer 40. The example tabs can be received against oppositely facing electromagnet core pole surfaces, for example, to secure the sliding layer 40 in a desired position. The example of FIG. 6 includes one end cap at one longitudinal end of the sliding layer 40.

Figure 7:
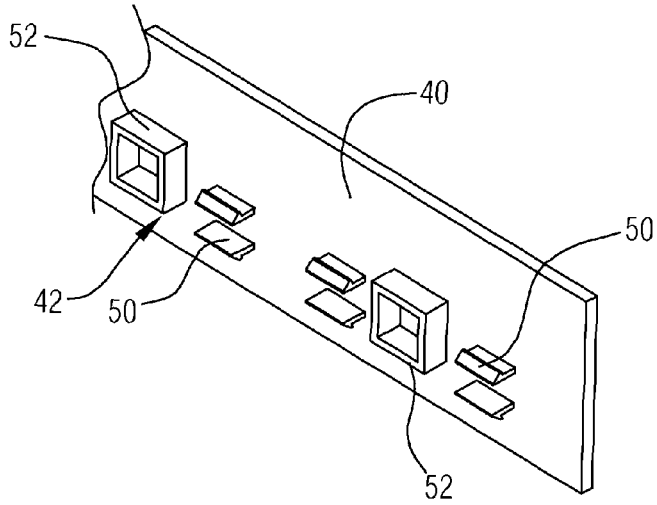
FIG. 7 is a perspective illustration of another example sliding layer.
Figure 8:
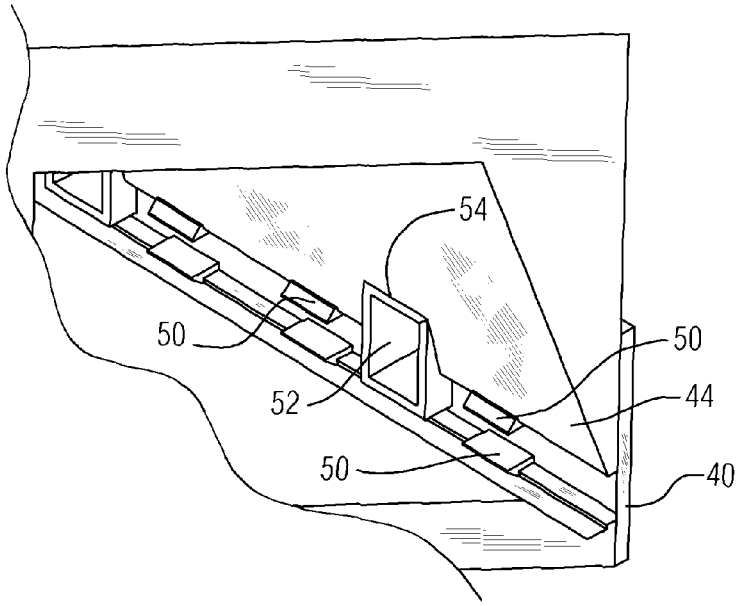
FIG. 8 schematically illustrates the example sliding layer of FIG. 7 mounted on an electromagnet.

FIGS. 7 and 8 show another example sliding layer 40. In this example, the mounting feature 42 includes locking tabs 50 that prevent the sliding layer 40 from being pulled away from an electromagnet once the sliding layer 40 is in a desired position. Positioning bosses 52 cooperate with recesses 54 on at least one electromagnet pole 44 to establish a longitudinal position of the sliding layer 40. When the bosses 52 are received in corresponding recesses 54, that prevents movement of the sliding layer 40 in a longitudinal direction (e.g., from right to left in the drawing). The locking tabs 50 secure the sliding layer 40 from being pulled away from the poles 44 of the electromagnet.

Figure 9:
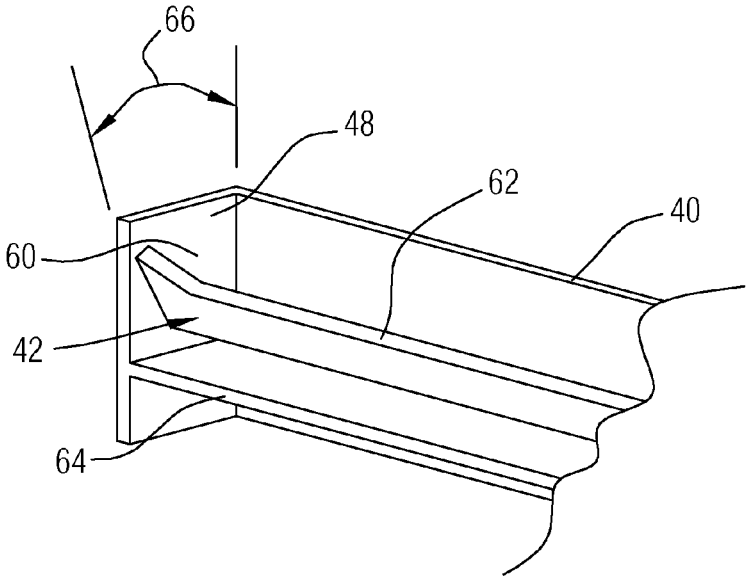
FIG. 9 is a perspective illustration of selected portions of another example sliding layer.
Figure 10:
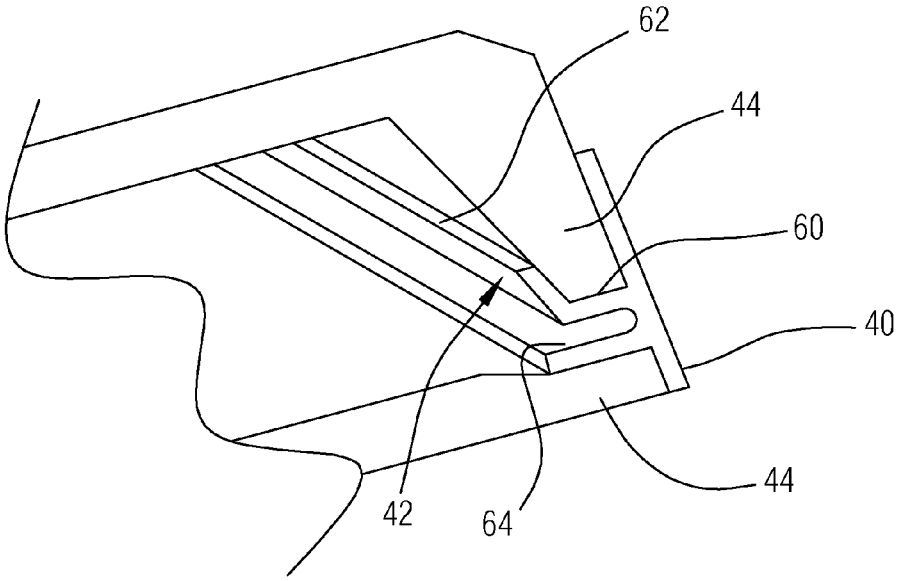
FIG. 10 schematically illustrates the example of FIG. 9 mounted on an electromagnet.
Figure 11:
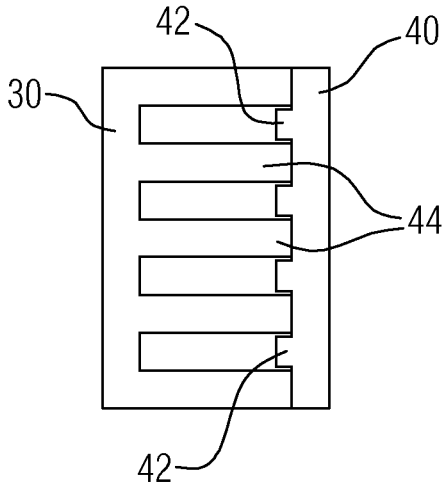
FIG. 11 schematically illustrates another electromagnet and sliding layer configuration.

FIGS. 9 and 10 show another example sliding layer arrangement. In this example, the mounting feature 42 includes a channel 60 on the sliding layer 40. An interior wall 62 establishes the channel 60 into which at least a portion of a pole 44 is received. Another surface 64 is received against another portion of a pole 44. In the illustrated example, the wall 62 establishes the channel 60 so that it has an oblique angle 66 relative to a surface of the sliding layer 40 that is generally parallel to a corresponding surface on an electromagnet pole 44. This oblique angle facilitates assembling the sliding layer 40 and the electromagnet by effectively snap-fitting the sliding layer 40 into place.

As can be appreciated from FIG. 10, for example, the sliding layer 40 may be manipulated in a generally clockwise direction (according to the drawing) relative to the electromagnet 30 to insert one pole 44 into the channel 60 while moving the wall 64 against the other pole 44. The illustrated sliding layer 40 effectively snaps into place against the electromagnet core such that it is secured in a desired position. The example of FIGS. 9 and 10 includes at least one end cap 48 to keep the sliding layer 40 from moving longitudinally relative to the electromagnet (e.g., generally from left to right according to the drawing).

One advantage to the disclosed examples is that no adhesive or other fasteners are required. This ensures an appropriate and desired alignment between the sliding layer 40 and the electromagnet. Additionally, replacement of such a sliding layer becomes easier because there is no need to dissolve a previously applied adhesive and no requirement for special tools to remove any fasteners.

The example sliding layers 40 facilitate the desired amount of electromagnetic coupling between an electromagnet and a vane member, prevent ferrous debris buildup on an electromagnet, accommodate relative movements during elevator car loading or unloading and minimize the amount of noise associated with establishing a magnetic coupling between the electromagnet and the vane member.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electromagnetic coupling device, comprising:

an electromagnet supported on one of an elevator car door or a hoistway door;

a vane member that is supported on the other of the hoistway door or the elevator car door, the vane member being positioned to be selectively magnetically coupled with the electromagnet; and a nonmagnetic slider layer supported on the electromagnet such that the slider layer is between the electromagnet and the vane member for maintaining a spacing between the electromagnet and the vane member, the spacing maintained by the non-magnetic slider layer being sufficient to decrease residual magnetism associated with any residual magnetic flux of the electromagnet after power is turned off to the electromagnet;

wherein the electromagnet comprises a plurality of core surfaces facing toward the vane member and wherein the slider layer engages at least one of the core surfaces;

wherein the slider layer comprises a mounting feature that is received against at least one of the core surfaces for securing the slider layer in a desired position relative to the core surfaces; and wherein the mounting feature comprises a plurality of tabs that engage at least one of the core surfaces.

2. The device of claim 1, wherein the tabs engage oppositely facing portions of the core surfaces, respectively, such that the tabs are secured between the oppositely facing portions.

3. The device of claim 1, wherein the mounting feature comprises a first portion for preventing the sliding layer from moving in a first direction relative to the electromagnet and a second portion that prevents the sliding layer from moving in a second, different direction relative to the electromagnet.

4. An electromagnetic coupling device, comprising:

an electromagnet supported on one of an elevator car door or a hoistway door;

a vane member that is supported on the other of the hoistway door or the elevator car door, the vane member being positioned to be selectively magnetically coupled with the electromagnet; and a nonmagnetic slider layer supported on the electromagnet such that the slider layer is between the electromagnet and the vane member for maintaining a spacing between the electromagnet and the vane member, the spacing maintained by the non-magnetic slider layer being sufficient to decrease residual magnetism associated with any residual magnetic flux of the electromagnet after power is turned off to the electromagnet;

wherein the electromagnet comprises a plurality of core surfaces facing toward the vane member and wherein the slider layer engages at least one of the core surfaces;

wherein the slider layer comprises a mounting feature that is received against at least one of the core surfaces for securing the slider layer in a desired position relative to the core surfaces; and wherein the mounting feature comprises a raised bead that is received between the core surfaces.

5. The device of claim 4, comprising a plurality of raised beads wherein one of the beads abuts a first one of the core surfaces and a second one of the beads abuts a second one of the core surfaces for securing the sliding layer in the desired position.

6. The device of claim 4, wherein the mounting feature comprises a first portion for preventing the sliding layer from moving in a first direction relative to the electromagnet and a second portion that prevents the sliding layer from moving in a second, different direction relative to the electromagnet.

7. An electromagnetic coupling device, comprising:

an electromagnet supported on one of an elevator car door or a hoistway door;

a vane member that is supported on the other of the hoistway door or the elevator car door, the vane member being positioned to be selectively magnetically coupled with the electromagnet; and a nonmagnetic slider layer supported on the electromagnet such that the slider layer is between the electromagnet and the vane member for maintaining a spacing between the electromagnet and the vane member, the spacing maintained by the non-magnetic slider layer being sufficient to decrease residual magnetism associated with any residual magnetic flux of the electromagnet after power is turned off to the electromagnet;

wherein the electromagnet comprises a plurality of core surfaces facing toward the vane member and wherein the slider layer engages at least one of the core surfaces;

wherein the slider layer comprises a mounting feature that is received against at least one of the core surfaces for securing the slider layer in a desired position relative to the core surfaces; and wherein the mounting feature comprises a plurality of locking tabs and at least one mounting boss.

8. The device of claim 7, wherein the mounting feature comprises a first portion for preventing the sliding layer from moving in a first direction relative to the electromagnet and a second portion that prevents the sliding layer from moving in a second, different direction relative to the electromagnet.

9. A method of assembling an electromagnetic coupling device, the method comprising the steps of:

providing an electromagnet;

providing a vane member;

positioning a nonmagnetic slider layer on one of the electromagnet or the vane member for maintaining a spacing between the electromagnet and the vane member during a coupling of the electromagnet and the vane member, the spacing being sufficient to reduce residual magnetism associated with residual magnetic flux of the electromagnet after power is turned off to the electromagnet;

snap-fitting the slider layer in a desired position on the one of the electromagnet or the vane member;

situating the electromagnet on one of an elevator car door or a hoistway door; and situating the vane member on the other of the hoistway door or the elevator car door.

10. The method of claim 9, comprising securing the slider layer to the one of the electromagnet or the vane member without any adhesive or fastener that is distinct from a material of the slider layer.

11. A method of assembling an electromagnetic coupling device, the method comprising the steps of:

providing an electromagnet;

providing a vane member;

positioning a nonmagnetic slider layer on one of the electromagnet or the vane member for maintaining a spacing between the electromagnet and the vane member during a coupling of the electromagnet and the vane member, the spacing being sufficient to reduce residual magnetism associated with residual magnetic flux of the electromagnet after power is turned off to the electromagnet;

securing the slider layer to the electromagnet by placing a mounting feature on the slider layer into engagement with at least one core surface on the electromagnet;

fitting the mounting feature between two core surfaces on the electromagnet;

situating the electromagnet on one of an elevator car door or a hoistway door; and situating the vane member on the other of the hoistway door or the elevator car door.

* * * * *